United States Patent [19]

Malik

[11] Patent Number: 4,869,447

[45] Date of Patent: Sep. 26, 1989

[54] WIRE RACK

[76] Inventor: James J. Malik, 6618 Bennington Dr., Parma Heights, Ohio 44130

[21] Appl. No.: 154,890

[22] Filed: Feb. 11, 1988

Related U.S. Application Data

[63] Continuation of Ser. No. 861,043, May 8, 1986, abandoned.

[51] Int. Cl.[4] ..... A63B 55/04

[52] U.S. Cl. ..... 248/97

[58] Field of Search ..... 248/95, 97, 99, 101, 248/100, 152, 153, 174, 175, 188.1

[56] References Cited

U.S. PATENT DOCUMENTS

| | | | |
|---|---|---|---|
| D. 273,159 | 3/1984 | Adamson | 248/97 |
| 1,145,297 | 7/1915 | Erickson | 248/97 |
| 2,269,257 | 1/1942 | Edwards | 248/97 |
| 2,314,490 | 3/1943 | Goldman | 248/97 |
| 2,504,572 | 4/1950 | Nygard | 248/97 |
| 2,942,823 | 6/1960 | Chapman | 248/97 |
| 4,062,170 | 12/1977 | Orem | 53/390 |
| 4,199,122 | 4/1980 | Christie | 248/97 |
| 4,458,867 | 7/1984 | Malik | 248/99 |
| 4,487,388 | 12/1984 | Provan | 248/97 |

FOREIGN PATENT DOCUMENTS

| | | | |
|---|---|---|---|
| 209756 | 12/1966 | Sweden | 248/100 |

*Primary Examiner*—Ramon O. Ramirez
*Assistant Examiner*—Robert A. Olson
*Attorney, Agent, or Firm*—Woodling, Krost and Rust

[57] ABSTRACT

An improved wire rack for holding plastic bags is disclosed. Each side panel of the wire rack is constructed of two pieces of bent wire, one piece thereof forming a solid support between two parts of the other piece parallel to a third part of the other piece. The base of the wire rack is sized and grooved to interact with the two formed wire pieces of the wire rack to lock solidly in place to form a unitary structure.

46 Claims, 4 Drawing Sheets

WIRE RACK

This is a continuation of co-pending application Ser. No. 861,043 filed on May 8, 1986, now abandoned.

BACKGROUND OF THE INVENTION

Wire bag racks are being met with increasing commercial acceptance. Racks such as those described in U.S. Pat. Nos. 4,062,170, 4,487,388 and 4,458,867 are both inexpensive and efficient. However, wire racks still have problems in the obstructions to bag removal, lack of downward strength, and in the ease of shearing the welds that are made to maintain unit integrity. These problems along with others unduly restrict the longevity and marketplace for wire racks.

SUMMARY OF THE INVENTION

The invention of this present invention relates to a wire rack construction characterized by the unique location and geometric orientation of a vertical reinforcing member.

It is an object of the invention to remove obstructions to bag removal from wire racks.

It is an object of the invention to significantly increase the downward compression strength and capacity of wire racks It is an object of the invention to eliminate shear type welds from wire racks.

It is an object of the invention to increase the life of wire racks.

It is another object of the invention to simplify the construction of wire racks.

The foregoing objects and other advantages of my invention will become apparent from an examination of the following drawings in which:

DESCRIPTION OF THE DRAWINGS

FIG. 3*b* shows the foot of the wire rack in open and engaged positions in respect to the plastic base;.

The invention of this application relates to an improved wire rack for use in loading for example plastic grocery bags having integral handle loops at the top thereof. As shown in FIGS. 1 and 2 the rack 20 includes two identical sides 21, 22, a back 23 and a base 24. The two sides 21, 22 are connected to the back 23 for rotational movement in respect thereto. The base 24 is removably connected to the two sides 21, 22 of the wire rack 20 in a manner to be later described.

Figure 1:
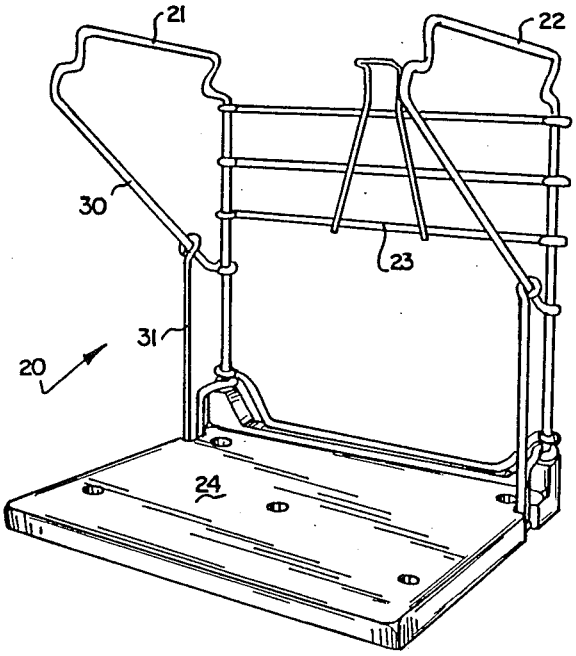
FIG. 1 is a perspective front view of a collapsible wire rack embodiment of my invention having a separate locking plastic base.

Each side 21, 22 of the wire rack 20 is formed out of two pieces 30, 31 of bent quarter inch diameter wire 32 respectively.

One piece 30 of wire is a continuous length of wire bent into roughly a letter "g" shape having a horizontal foot member 33, a vertical intermediate member 34, a horizontal attachment member 35 and a support member 36. The vertical intermediate member 34 extends substantially 90 degrees off of the horizontal foot member 33 upwards to the horizontal attachment member 35. The support member 36 extends off of the outer end of the horizontal attachment member 35 to the vertical member 34. The support member 36 shown is angular. It could be any shape as long as it in combination with the other parts of the rack 20 pass the forces between the attachment means 35 to the foot 33 and vertical intermediate member 34. Examples of alternate shapes include curved, square or combination shapes The lower inner end 37 of the angular support member 36 is wrapped about the vertical intermediate member 34 at about the midpoint thereof so as to form substantially a right triangle made up of the top half of the vertical intermediate member 34, the horizontal attachment member 35 and the angular support member 36. The horizontal attachment member 35 includes an upright section 38 for use in holding the handles of the open bag held by the rack 20 as is known.

The other piece 31 of wire, generally separate from the first piece, is bent into a vertical reinforcer 40 and a right angle tab 41. The vertical reinforcer 40 is oriented within ±30 degrees and preferably ±10 degrees in respect to a line 45 parallel to the vertical intermediate member 34 of the first piece 30 of wire from a wrap 42 about the lower end of the angular support member 36 to a weld 43 with the horizontal foot member 33. The vertical reinforcer 40 is ideally in the same plane as the first piece 30 of wire substantially parallel to the vertical support member 34 and at the back of the rack behind the midpoint- of the attachment member 35. (In the drawings line 45 is coextensive with the longitudinal axis of the reinforcer 40.) The location of the vertical reinforcer 40 (near the vertical intermediate member 34 at the back of the rack 20) removes all obstructions from the front of the rack 20. The bags held by the rack 20 can therefor be filled, even overfilled, and then removed from the rack, normally slid out in a forward direction, without hindrance or damage to the bag. This feature speeds up the packing process by eliminating any concern for the strength and/or removal of the bag from the packing process as present in prior designs; the groceries can literally be thrown into the bag maximizing speed while minimizing care. The rack design of this invention eliminates braces or supports that would otherwise tend to trap or resist removal of filled bags from the rack. Even limp bags can be used without risk of the bags being nicked, torn or weakened on removal. There is no limit to the effective width of the bag. The improved rack design increases customer goodwill (and reduces the cost of packing) by minimizing the potential for bag tears and subsequent article spillage/repacking from the checkout/carryout process. The weld 43 is preferably a resistance weld. Other attachment means could also be used. The right angle tab 41 extends from the weld 43 upwards to a wrap 44 about the bottom of the vertical intermediate member 34.

Due to the connections and orientation of the vertical reinforcer 40 any downward force on the horizontal attachment member 35 is transferred first to the inner lower end of the angular support member 36 and then through the vertical reinforcer 40 directly to the horizontal foot member 33. This transfer of force substantially increases the downward strength and flex rigidity of the rack 20 over that of prior designs. The loads on the rack 20 are efficiently absorbed with a minimum deflection. This allows a bag in the rack to be filled faster with heavier articles. Since the vertical reinforcer 40 abuts the horizontal foot member 33 in an inverted "T" joint, the downward forces on the vertical support 40 are efficiently dissipated into the horizontal foot member 33. As the weld 43 at this location is subject to compression forces it is not prone to failure as a shear weld would be. As all the other joints are wrapped around interconnections the rack 20 can flex slightly to absorb forces that would cause a failure of the welds in prior designs. The rack 20 is therefor tougher than these prior designs.

The tab 41 serves to hold the lower end of the vertical reinforcer 40 in place as well as to resist the fore-aft flexing of the reinforcer 40 - intermediate member 34 rectangle. The tab 41 also serves to retain the base 24 in place as will be later described. In an alternate version the tab 41 could extend at approximately the same height forward of the vertical reinforcer 40 to join the foot member 33 instead of the intermediate member 34 and thus serve as a low height side rail. This tab could even be a fold back unitary continuation of the end of the foot member 33. This forward extending tab would retain the bottom of the bag held by the rack in line with the base 24 without creating an obstruction to bag removal. In the embodiments shown both pieces 30, 31 of each side 21, 22 lie in a single plane having a depth substantially the thickness of the wire 32; there is no member significantly offset from another member This reduces the volume of the rack with consequent lower shipping costs.

Figure 5:
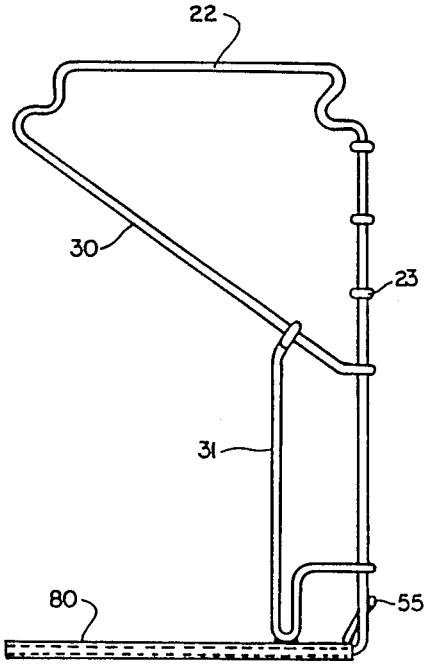
FIG. 5 is a side view of the non-collapsible wire rack of FIG. 4.
Figure 6A:
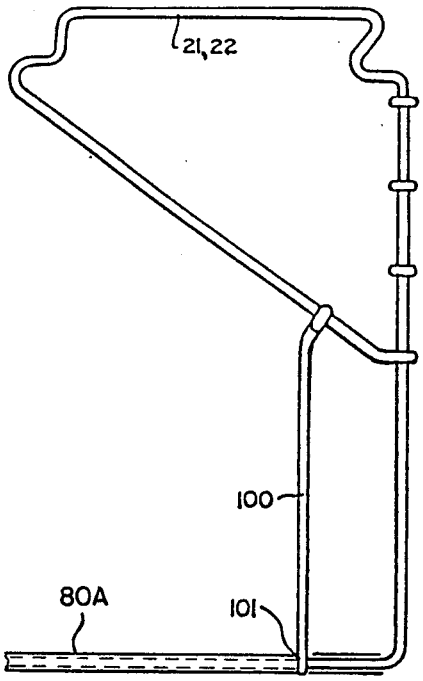
FIGS. 6A, 6B and 6C are a series of views of differing side panels of alternate wire racks incorporating my invention.
Figure 6B:
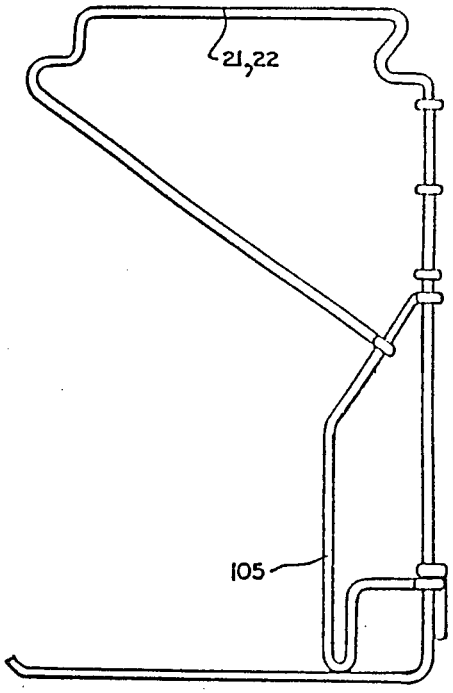
Figure 6C:
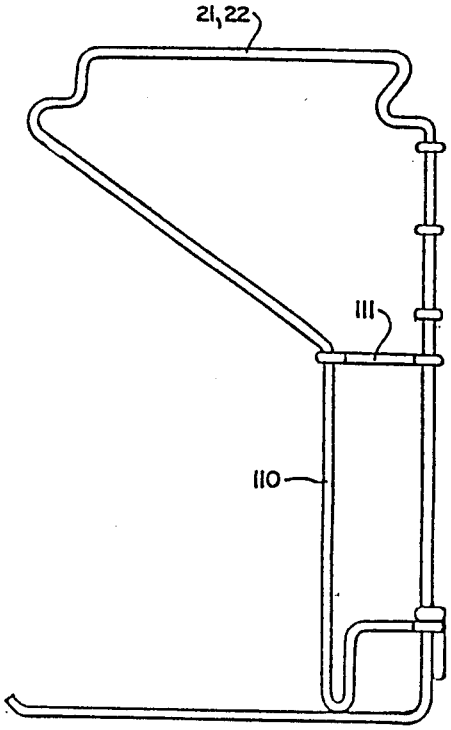
Figure 7:
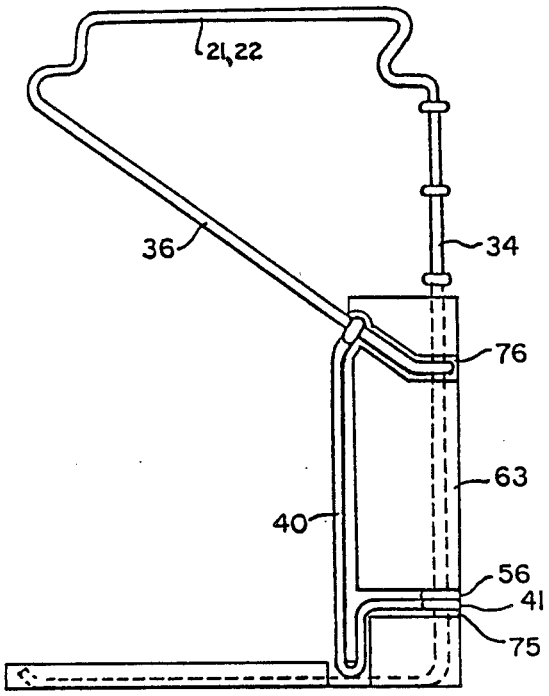

Alternate possibilities for the sides 21, 22 of the rack 20 are shown in FIG. 6. In FIG. 6*a* the support member 100 is wrapped about the angular support member 36 and the horizontal foot member 33. By having a lower wrapped joint 101 this embodiment does not have possible weld fatigue and/or separation problems. In FIG. 6*b* the support 105 extends to the vertical intermediate member 34 directly In FIG. 6*c* the support 110 extends off of the angular support member 36 with a separate wrapped end piece 111 tying the support 110 - angular support member 36 to the vertical intermediate member 34. Some sort of stop retains the piece 111 in its approximate position. In all embodiments including that of FIGS. 1-5 the horizontal foot member 33 extending beyond the location of the lower end of the vertical reinforcer could be or include a third piece of wire welded or otherwise affixed to the other pieces of wire 30, 31. An example would be a sidewards "L" shaped piece extending off of the corner joining the vertical 34 and horizontal 33 members All racks allow for the efficient transfer of forces between the reinforcer 40 and the foot member 33.

The two sides 21, 22 are joined together by the back 23. The back 23 includes a horizontal spacer 50 and a horizontal reinforcing piece 51 The horizontal spacer 50 is a series of three equal length straight wire bars 52 joined by a bag supply holder 53. The bag supply holder 53 is generally triangular in shape with an upwardly extending loop for holding the bag supply as is known The opposing ends 54 of each wire bar 52 are wrapped about the upper portion of the vertical members 34 of the side pieces 21, 22 respectively. (The wire bars 52 are welded to the supply holder 53 so as to form the single unitary spacer 50.) The opposing ends 56 of the single horizontal reinforcing piece 51 are wrapped about the lower portion of the vertical members 34 of the side pieces 21, 22. The shape of this piece 51 is chosen to minimize any interfere with the designed use of the rack while maximizing strength. In the rack of FIG. 1 this means being bent so as to have a middle section tracking the top of the base 24. Note that both bases 60, 80 are designed to retain the bottoms of the side pieces 21, 22 in a set spaced relationship. As such the piece 51, although preferred, is optional with these bases 60, 80.

Figure 2:
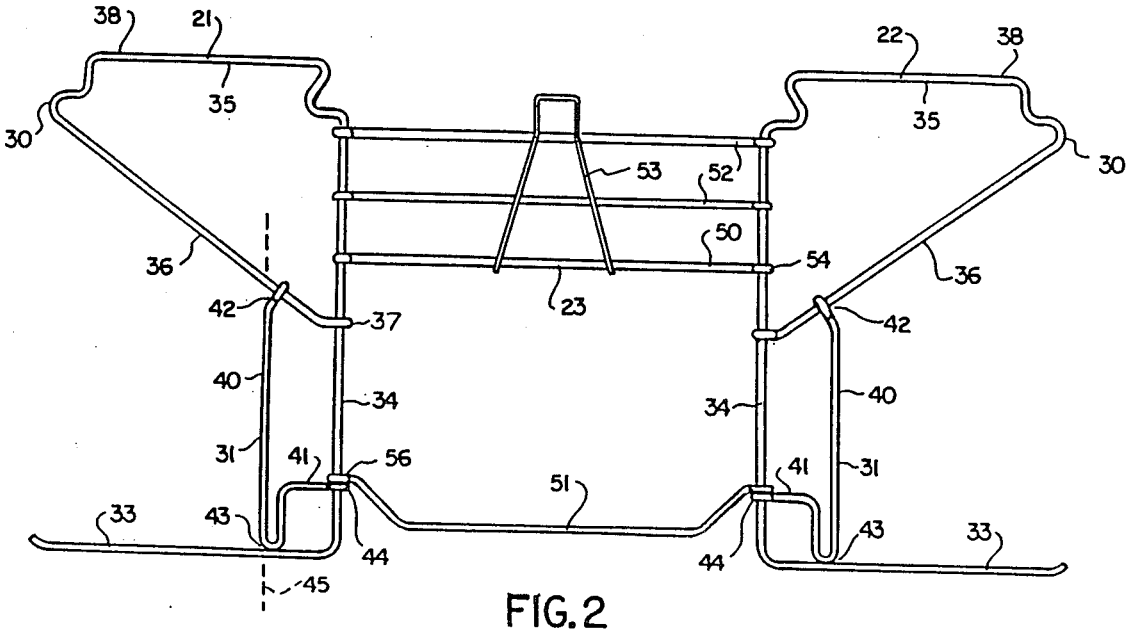
FIG. 2 is an open plan view of the wire rack of FIG. 1 with the side panels folded into an expanded position.

The side pieces 21, 22 are free to swing abut their respective ends of the back 23 (as shown in FIGS. 1 and 2). This ability facilitates the shipping of the rack 20 and the attachment of any base 24.

Figure 3A:
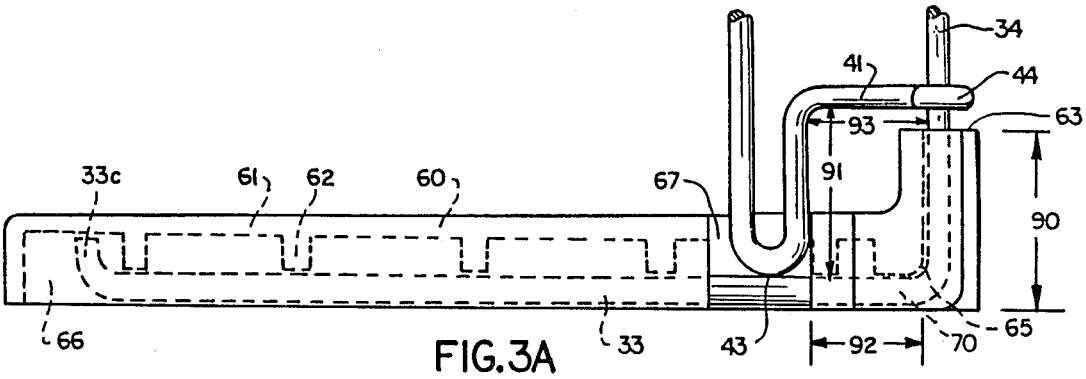
FIG. 3*a* is an expanded side view of the foot of the collapsible wire rack of FIG. 1. This figure details the cooperation between the wire rack and the plastic base.
Figure 3B:
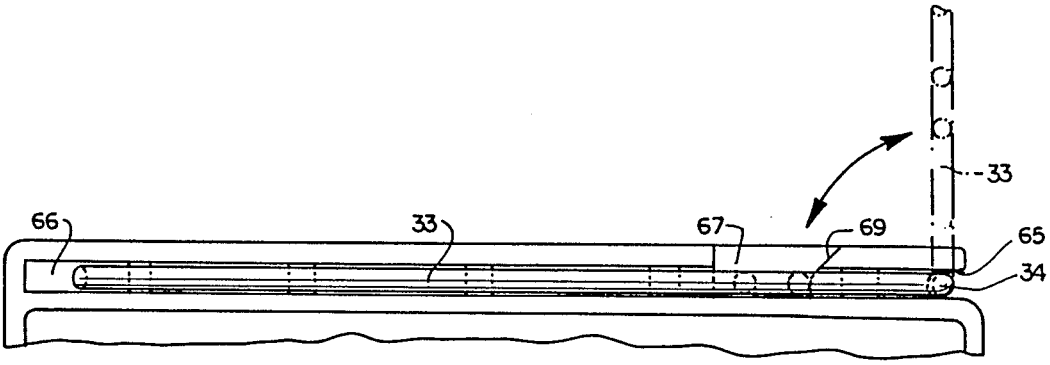
FIG. 3*b* is an expanded partial bottom view of the foot of the collapsible wire rack of FIG. 3*a*. This

The base 24 can be a removable base 60, a non-removable wrapped around base 80 or otherwise. The removable base 60 shown in FIGS. 1 and 3 is a flat reinforced plate 61 molded of an injectable plastic such as nylon, abs, or polypropylene. Reinforcing ribs 62 increase the rigidity of the base 60. At the rear corners of the base 60 two generally triangular shaped support angles 63 protrude from the plate 61. The total height 90 of the plate 61 and support angle 63 of the base 60 is preferably substantially equal to or slightly less than the distance 91 between the horizontal foot member 33 and the right angle tab 41 (for reasons to be later described). A separate stop could be substituted for the tab 41. A groove 65 extends into the support angle 63 and the plate 61 of the base 60 from the rear thereof and a second groove 66 extends into the plate 61 from the bottom thereof A separate notch 67 extends from the side of the plate 61 into the second groove 66 a certain distance 92 from the inner surface of the groove 65 in the rear of the base 60. This distance 92 is substantially equal to the distance 93 between the downwardly extending leg of the tab 41 and the vertical intermediate member 34. The rearmost edge 69 of the notch 67 is beveled or curved (for reasons to be later described).

To attach the removable base 60 to the rack 20 one locates the base 60 in respect to the rack 20 such that the rack 20 is in an open position corresponding to that shown in FIG. 2 with the grooves 65 on either side of such base 60 engaging the lowermost portions of the vertical intermediate member 34 between the tab 41 and the horizontal foot member 33 of each side 21, 22 of the rack 20 respectively. Due to the relationship between distance 91 of the rack 20 and distance 90 of the base 60 (distances about equal) the fit between these parts at this semi-engaged position is tight. At this time the sides 21, 22 of the rack 20 are swung substantially 90 degrees about the longitudinal axis of the vertical member 34 - respective groove 65 of the base 60 (motion shown in FIG. 3*b* - starting position in dotted lines, ending position in solid lines). This motion lines the horizontal foot member 33 up with the groove 66 in the bottom of the base 60 and engages the "T" joint between the vertical support member 36 and such horizontal foot member 33 in the notch 67. The horizontal foot member 33 has to be slightly flexed in this movement or the base 60 lifted at its outer end to allow clearance for the upwardly extending tip 33c at the outer end of the horizontal foot member 33. The beveling or curving of the rearmost edge 69 of the notch 67 insures that the swinging motion is relatively unimpeded and that no shearing forces are placed on the weld 43 Since distance 93 of the rack 20 is substantially equal to the distance 92 of the base 60, with the weld 43 in the notch the rack 20 cannot move backwards or forwards in respect to the base 60. Once the horizontal foot member 33 is lined up with the groove 66 the base 60 is pressed downward to engage the full extent of the groove 66 about the horizontal foot member 33 as shown in solid line in FIG. 3.

With the base 60 thus attached to the rack 20, the base 60 is unlikely to be accidentally separated from the rack 20. If the front of the base 60 is knocked upwards such that the tip 33*c* of the horizontal foot member 33 is clear, this same motion would rotate the rear of the base 60 and by engaging the top of the support angle 63 with the tab 41 effectively lock the horizontal foot member 33 against any rotation in respect to the base Lifting the back of the base 60 would leave the tip 33*c* of the horizontal foot member 33 engaged. Even if the entire base 60 is lifted it still cannot be disengaged from the rack 20 without swinging both of the sides 21, 22 of the rack 20 a sufficient number of degrees to allow clearance for forward motion of the support angle 63 under the tab 41 and at the same time applying such forward motion on the base 60. This combination of motion is unlikely to occur accidentally. Therefor once engaged the base 60 is effectively locked in place against accidents.

In an alternate embodiment of the base 60 the support member 63 could be designed for sidewards instead of upwards connection of the horizontal foot member 33. To provide for this the side 70 of the groove 66 would be removed between the notch 67 and the rear of the base 60. The removal of this side 70 would allow the horizontal foot member 33 to be slid sideways into the groove 66 under the support member 63. (The groove 66 in front of the notch 67 would retain its side and the upward connection.) The removal of the side 70 effectively offsets the critical distance 90 from the bottom of the base 60 to the top of the groove 66. For this reason the support member 63 of this alternate embodiment could extend the full vertical distance between the horizontal foot member 33 and the tab 41. If desired the support member 63 could even extend vertically from the horizontal foot member 33 to above the support member 36 (with the tab 41 and support member 36 residing in appropriate notches in the side of the extended support member 63) and also extend from the intermediate member 34 to the reinforcer 40. This extended support member would effectively fill the entire rectangle between the reinforcer 40 and intermediate member 36 from the horizontal foot member 33 to above the support member 36 and thus tie the base 60 and rack into a single unitary piece. Note that it may be necessary to angle, taper or otherwise cut away various portions of the base 60 so as to ease the assembly of base 60 to rack 20, primarily in respect to the insertion of the horizontal foot member 33 into the grooves 66 outside of the weld 43. In this alternate enlarged support member embodiment any downward forces on the end of the base would be efficiently dissipated throughout the entire rack 20. With the addition of a small swing plate (now shown) bolted or otherwise affixed to the base 60 beneath the horizontal foot member 33 at or outside of the weld 46, the rack 20 would be essentially invulnerable from damage in any normal usage.

Figure 4:
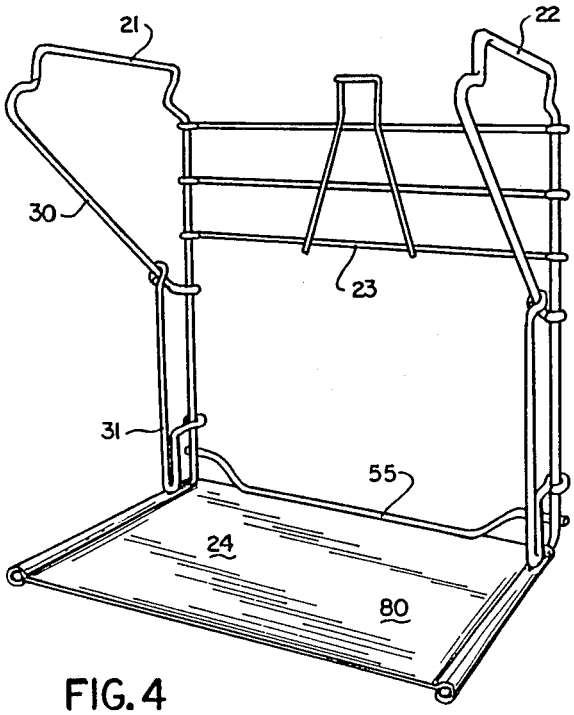
FIG. 4 is a perspective view of a non-collapsible wire rack similar to the wire rack of FIG. 1. This non-collapsible wire rack has a wrapped around sheet metal base.

An alternate base 24 is shown in FIGS. 4 and 5. In these figures a piece of sheet metal 80 is tightly wrapped about the horizontal foot members 33 of both sides 21, 22 before the creation of the weld 43. This effectively locks the rack 20 into a single unitary structure with the base 80. The reinforcing piece 55 in this particular rack is welded instead of wrapped about the sides 21, 22 of the rack 20. The front portion of the base 80 is bent down in a curved section to provide a rigidity against flexing. In an alternate embodiment the sheet metal base 80A would be fabricated with slightly oversided tubular side sections separately from the rack 20 and the reinforcing piece 55 wrapped about the sides 21, 22. The wire rack itself would be fabricated with the weld 43 made to the horizontal foot member 33. The rack 20 would then be shipped collapsed to the location of use with the base 80 separate therefrom. At the location of use the rack 20 would be unfolded into its approximate position of use and the horizontal foot members 33 of the rack 20 slipped axially into the tubular side sections and locked in place (rivet through a hole, indenting part of the tubular sheet metal into a cavity on the foot member, a fold over tab behind the weld 43 or over the reinforcing piece 55, glue etc.). The rack 20 would then essentially be the functional and strength equivalent to the unitary wrapped base rack. Note that in this alternate embodiment there would be no wrap around in the section behind the weld 43 so as to allow for this slip on construction. As the forces at this location are minimal this loss would not reduce the effective strength of the rack. If more base strength was desired at the rear of the rack, the base 80 could be run over the top of the reinforcing piece 55, preferably with a slight curl over bend This base would serve to hold the base 80 in place in addition to adding flex strength to the base 80. This alternate slip-on embodiment could be shipped flat, thus reducing shipping costs, while preserving all the advantages of a unitary structure.

Although this invention has been described in its preferred form with a certain degree of particularity, it is to be understood that numerous changes can be made in the form and structure of the disclosed embodiments without departing from the scope of the invention as hereinafter claimed.

What is claimed is:

1. In a wire rack having a side with a horizontal foot member, a vertical intermediate member extending from an end of the foot member, and a support member extending upwardly relative to a point between the ends of the intermediate member, the foot member having an outer end, the improvement of a reinforcer, said reinforcer extending between the support member and the foot member alongside of the intermediate member therebetween, and said reinforcer connected to the foot member a spaced distance from the outer end thereof, said reinforcer strengthening the wire rack.

2. The improved wire rack of claim 1 characterized in that said reinforcer is a separate piece from the foot member.

3. The improved wire rack of claim 1 in that there is a line parallel to the intermediate member, said reinforcer has a length, and wherein most of said length of said reinforcer is oriented plus or minus 30 degrees in respect to a line parallel to the intermediate member.

4. The improved wire rack of claim 1 wherein said reinforcer is oriented substantially parallel to the intermediate member.

5. The improved wire rack of claim 1 characterized in that the connection between said reinforcer and the foot member is an inverted "T" joint.

6. The improved wire rack of claim 5 characterized in that the connection between said reinforcer and the foot member is in line with the foot member and the inverted "T" joint is a weld connection.

7. The improved wire rack of claim 1 characterized by the addition of a tab, and said tab extending between said reinforcer and the intermediate member.

8. The improved wire rack of claim 7 wherein said reinforcer has a bottom end and characterized in that said tab extends off of the bottom end of said reinforcer as a continuation thereof.

9. The improved wire rack of claim 1 characterized by the addition of a stop, said stop being on the intermediate member, said stop being a certain distance A from the foot member, a base, said base surrounding part of the intermediate member between said stop and the foot member, the base having a total vertical height at its intersection with the intermediate member, and said vertical height of said base being substantially equal to said certain distance A, the resultant cooperation allowing the selective combination of base and rack to form a unitary structure.

10. The improved wire rack of claim 1 characterized by the addition of a stop, said stop being on the intermediate member, said stop being a certain distance A from the foot member, said reinforcer joining the foot member a certain distance B from the intermediate member, a base, said base surrounding part of the foot member and part of the intermediate member near the joint therebetween, said base having a total vertical height at its intersection with the intermediate member, said vertical height of said base being substantially equal to said certain distance A, the intermediate member being inset into said base to a point of pivoting, said base having a notch in its side, said notch being a certain distance C from said point of pivoting of the intermediate member, said distance C being substantially equal to said distance B, and said reinforcer extending through said notch to join the foot member, the resultant cooperation allowing the selective combination of base and rack to form a unitary structure.

11. The improved wire rack of claim 1 wherein there are two sides joined by a back connecting the upper portions thereof and characterized by the improvement of a reinforcing piece, said reinforcing piece connecting the lower portions of the two sides.

12. The improved wire rack of claim 1 characterized by the addition of a base, said base having a tubular side, said tubular side surrounding the foot member between the reinforcer joint with the foot member and the outer end of the foot member, and said tubular side being removable from the foot member.

13. The improved wire rack of claim 12 characterized by the addition of affixing means to fixedly connect said base to the rack so as to prevent the separation thereof.

14. The wire rack of claim 1 wherein the wire rack has two sides and characterized by the addition of a back, and said back having ends wrapped around said intermediate member of the two sides, respectively, to maintain the sides in a spaced relationship.

15. The improved wire rack of claim 1 characterized by the addition of a stop, said stop being on the intermediate member, said stop being a certain distance A from the foot member, a base, said base surrounding part of the intermediate member between said stop and the foot member, the base having a total vertical height at its intersection with the intermediate member, and said vertical height of said base being greater than said certain distance A, said base extends above said stop with said stop being in a notch in said base, the resultant cooperation allowing the selective combination of base and rack to form a unitary structure.

16. In a wire rack having a side with horizontal foot member, a vertical intermediate member extending from an end of the foot member, and a support member extending upwardly relative to a point between the ends of the intermediate member, the side formed from a single piece of bent wire, the foot member having an outer end, the improvement of a reinforcer, said reinforcer being of a piece of wire, said reinforcer extending between the support member and the foot member alongside the intermediate member and said reinforcer joining the foot member a spaced distance from the outer end thereof, said reinforcer passing additional forces between the support member and the foot member.

17. The improved wire rack of claim 16 in that there is a line parallel to the intermediate member, said reinforcer has a length, and wherein most of said length of said reinforcer is oriented plus or minus 30 degrees in respect to a line parallel to the intermediate member.

18. The improved wire rack of claim 16 wherein said reinforcer is oriented substantially parallel to the intermediate member.

19. The improved wire rack of claim 16 characterized in that said reinforcer joins the foot member in an inline inverted "T" joint.

20. The improved wire rack of claim 16 characterized by the addition of a tab, said tab extending off of the reinforcer near the joint with the foot member, said tab extending to the intermediate member and said tab being formed from the same piece of wire as said reinforcer.

21. The improved wire rack of claim 16 characterized by the addition of a stop, said stop being on the intermediate member, said stop being a certain distance A from the foot member, a base, said base surrounding part of the intermediate member between said stop and the foot member, the base having a total vertical height at its intersection with the intermediate member, and said vertical height of said base being substantially equal to said certain distance A, the resultant cooperation allowing the selective combination of base and rack to form a unitary structure.

22. The improved wire rack of claim 16 characterized by the addition of a stop, said stop being on the intermediate member, said stop being a certain distance A from the foot member, said reinforcer joining the foot member a certain distance B from the intermediate member, a base, said base surrounding part of the foot member and part of the intermediate member, said base having a total vertical height at its intersection with the intermediate member, said vertical height of said base being substantially equal to said certain distance A, the intermediate member being inset into said base to a point of pivoting, said base having a notch in its side, said notch being a certain distance C from said point of pivoting of the intermediate member, said distance C being substantially equal to said distance B, and said reinforcer extending through said notch to join the foot member, the resultant cooperation allowing the selective combination of base and rack to form a unitary structure.

23. The improved wire rack of claim 16 characterized by the addition of a base, said base having a tubular side, said tubular side surrounding the foot member between the reinforcer joint with the foot member and the outer end of the foot member, and said tubular side being removable from the foot member.

24. The improved wire rack of claim 23 characterized by the addition of affixing means to fixedly connect said base to the rack so as to prevent the separation thereof.

25. The improved wire rack of claim 16 characterized by the addition of a stop, said stop being on the intermediate member, said stop being a certain distance A from the foot member, a base, said base surrounding part of the intermediate member between said stop and the foot member, the base having a total vertical height at its intersection with the intermediate member, and said vertical height of said base being greater than said certain distance A, said base extends above said stop with said stop being in a notch in said base, the resultant cooperation allowing the selective combination of base and rack to form a unitary structure.

26. The improved wire rack of claim 16 characterized by the addition of a stop, said stop being on the intermediate member, said stop being a certain distance A from the foot member, said reinforcer joining the foot member a certain distance b from the intermediate member, a base, said base surrounding part of the foot member and part of the intermediate member, said base having a tool vertical height at its intersection with the intermediate member, said vertical height of said base being greater than said certain distance A, said base extends above said stop with said stop being in a notch in said base, the intermediate member being inset into said base to a point of pivoting, said base having an additional notch in its side, said additional notch being a certain distance C from said point of pivoting of the intermediate member, said distance C being substantially equal to said distance B, and said reinforcer extending through said additional notch to join the foot member, the resultant cooperation allowing the selective combination of base and rack to form a unitary structure.

27. The improved wire rack of claim 16 wherein there are two sides having upper and lower portions and with the upper portions of the two sides connected by a back and characterized by the improvement of a reinforcing piece, said reinforcing piece connecting the lower portions of the two sides.

28. The improved wire rack of claim 27 characterized in that the connection between said reinforcer and the foot member is in line with the foot member and the inverted "T" joint is a weld connection.

29. The improved wire rack of claim 27 characterized in that the reinforcer extends from the foot member to join the intermediate member a certain distance A from the foot member, said reinforcer joining the foot member a certain distance B from the intermediate member, the support member joining the intermediate member a certain distance D from the foot member, a base, said base surrounding the foot member between the reinforcer and the intermediate member and the intermediate member from the foot member to beyond the support member, said base having a total vertical height at its intersection with the intermediate member, the vertical height of said base being greater than said certain distance D, the intermediate member being inset into said base to a point of pivoting, said base having a notch in its side, said notch being a certain distance C from said point of pivoting of the intermediate member, said distance C being substantially equal to distance B, said reinforcer extending through said notch to join the foot member, said base having a second notch in its side, said second notch being a certain distance E from the foot member, said distance E being substantially equal to said certain distance A, said reinforcer being in said second notch to join the intermediate member, said base having a third notch in its side, said third notch being a certain distance F from the foot member, said distance F being substantially equal to said certain distance D, and the support member being in said third notch to join the intermediate member, the resultant cooperation allowing the selective combination of base and rack to join a unitary structure.

30. The improved wire rack of claim 27 characterized in that said reinforcer joins the foot member in an inverted "T" joint.

31. The improved wire rack of claim 30 characterized by the addition of a base, said base having a tubular side, said tubular side surrounding the foot member between the reinforcer joint with the foot member and the outer end of the foot member, and said tubular side being selectively removable from the foot member.

32. The improved wire rack of claim 27 characterized in that the reinforcer extends from the foot member to join the intermediate member a certain distance A from the foot member, said reinforcer joining the foot member a certain distance B from the intermediate member, a base, said base surrounding part of the foot member between the reinforcer and the intermediate member and part of the intermediate member between the foot member and said reinforcer, said base having a total vertical height at its intersection with the intermediate member, the vertical height of said base being substantially equal to said certain distance A, the intermediate member being inset into said base to a point of pivoting, said base having a notch in its side, said notch being a certain distance C from said point of pivoting of the intermediate member, said distance C being substantially equal to distance B, and said reinforcer extending through said notch to join the foot member, the resultant cooperation allowing the selective combination of base and rack to join a unitary structure.

33. The improved wire rack of claim 32 wherein said reinforcer is oriented plus or minus 30 degrees in respect to a line parallel to the intermediate member.

34. The improved wire rack of claim 33 wherein said reinforcer is oriented substantially parallel to the intermediate member.

35. In a wire rack having a side with a horizontal foot member, a vertical intermediate member extending from an end of the foot member, and a support member extending upwardly relative to a point between the ends of the intermediate member, the side formed from a single piece of bent wire, the foot member having an outer end, the improvement of a reinforcer, said reinforcer being of a second piece of wire, said reinforcer extending between the support member and the foot member substantially parallel to the intermediate member and then continuing from the foot member to the intermediate member, and said reinforcer joining the foot member a spaced distance from the outer end thereof, said reinforcer passing additional forces between the support member and intermediate member and the foot member.

36. A wire rack for holding a plastic bag having handle loops, said wire rack comprising (a) two sides, each side formed of two pieces of wire, one piece of wire lying in a single plane and bent to provide a horizontal foot member to support a bag support means, a vertical intermediate member, a horizontal attachment member to engage the handle loops and an angular support member means having a wrapped connection with the vertical intermediate member with the second piece of wire lying in the same plane as the first piece of wire extending as a reinforcer between said angular support member means and said horizontal foot member substantially parallel to said vertical intermediate member to connect to said horizontal foot member in a substantially in line inverted "T" joint a spaced distance from the outer end thereof, (b) a back, said back having ends wrapped around said vertical intermediate member of said two sides, respectively, to maintain said sides in a spaced relationship, and (c) a bag support means, and said bag support means connected to said horizontal foot member of said two sides, respectively, to support the bottom of the bag.

37. The wire rack of claim 36 characterized in that said second piece of wire extends from part of said first piece of wire to said horizontal foot member and then to connect with said vertical intermediate member in a wrapped connection as a tab.

38. The wire rack of claim 36 characterized by the addition of a reinforcing piece and said reinforcing piece wrapped around said vertical intermediate member of said two sides near said horizontal foot member.

39. The improved wire rack of claim 36 in that the reinforcer of each side has an end and characterized by the addition of each side having a tab, said tab extending off of the end of said reinforcer near said joint with said horizontal member, said tab extending to said intermediate member and said tab being formed from the same piece of wire as said reinforcer.

40. A wire rack for holding a plastic bag having handle loops, said wire rack comprising (a) two sides, each side formed of two pieces of wire, one piece of wire lying in a single plane and bent to provide a horizontal foot member to support a bag support means, a vertical intermediate member, a horizontal attachment member to engage the handle loops and an angular support member means having a wrapped connection with the vertical intermediate member with the second piece of wire lying in the same plane as the first piece of wire extending as a reinforcer between said angular support member means and said horizontal foot member substantially parallel to said vertical intermediate member to connect to said horizontal foot member in a substantially in line inverted "T" joint a spaced distance from the outer end thereof, said second piece of wire having a wrapped connection with said angular support member means, (b) a back, said back having ends wrapped around said vertical intermediate member of said two sides, respectively, to maintain said sides in spaced relationship, and (c) a bag support means, and said bag support means connected to said horizontal foot member of said two sides, respectively, to support the bottom of the bag.

41. The wire rack of claim 40 characterized in that said second piece of wire extends from said angular support member to said horizontal foot member and then to connect with said vertical intermediate member in a wrapped connection as a tab.

42. The wire rack of claim 40 characterized by the addition of a reinforcing piece and said reinforcing piece wrapped around said vertical intermediate member of said two sides near said horizontal foot member.

43. A wire rack for holding a plastic bag having handle loops, said wire rack comprising (a) two sides, each side formed of two pieces of wire, one piece of wire lying in a single plane and bent to provide a horizontal foot member to support a bag support means, a vertical intermediate member, a horizontal attachment member to engage the handle loops, an angular support member and a reinforcer extending from an end of said angular support member, said reinforcer having a substantially inline inverted "T" connection with the horizontal foot member a spaced distance from the outer end thereof with the other piece of wire lying in the same planes as the first piece of wire extending between said reinforcer and said vertical intermediate member with wrapped connections about each said reinforcer and said vertical intermediate member, (b) a back, said back having ends wrapped around said vertical intermediate member of said two sides, respectively, to maintain said sides in spaced relationship, and (c) a bag support means, and said bag support means connected to said horizontal foot member of said two sides, respectively, to support the bottom of the bag.

44. The wire rack of claim 43 characterized in that said first piece of wire extends from its reinforcer inverted "T" connection with said horizontal attachment member further to said vertical intermediate member in a wrapped connection as a tab.

45. The wire rack of claim 43 characterized by the addition of a reinforcing piece and said reinforcing piece wrapped around said vertical intermediate member of said two sides near said horizontal foot member.

46. A wire rack for holding a plastic bag having handle loops, said wire rack comprising (a) two sides, each side formed of wire, one section of wire lying in a single plane and bent to provide a horizontal foot member to support a bag support means, a vertical intermediate member, a horizontal attachment member to engage the handle loops and an angular support member, with another section of wire lying in the same plane as the first section of wire extending as a reinforcer between said angular support member and said horizontal foot member substantially parallel to said vertical intermediate member to connect to said horizontal foot member in a substantially in line inverted "T" joint a spaced distance from the outer end thereof, means to connect said angular support member to said vertical intermediate member, (b) a back, said back having ends wrapped around said vertical intermediate member of said two sides, respectively, to maintain said sides in spaced relationship, and (c) a bag support means, and said bag support means connected to said horizontal foot member of said two sides, respectively, to support the bottom of the bag.

* * * * *